US007607460B2

(12) United States Patent
Johns et al.

(10) Patent No.: US 7,607,460 B2
(45) Date of Patent: Oct. 27, 2009

(54) COUPLING ASSEMBLY

(75) Inventors: Garry P. Johns, Mission Viejo, CA (US); Corey N. Johns, Mission Viejo, CA (US); Tim Kuitems, Orange, CA (US)

(73) Assignee: JPRO Dairy International, Inc., Mission Viejo, CA (US)

( * ) Notice: Subject to any disclaimer, the term of this patent is extended or adjusted under 35 U.S.C. 154(b) by 582 days.

(21) Appl. No.: 11/451,857

(22) Filed: Jun. 12, 2006

(65) Prior Publication Data

US 2007/0289670 A1 Dec. 20, 2007

(51) Int. Cl.
*B65B 1/04* (2006.01)

(52) U.S. Cl. ..... 141/329; 141/319; 141/320; 141/321

(58) Field of Classification Search ..... 141/319–322, 141/325, 326, 329, 330; 222/129; 206/219–222
See application file for complete search history.

(56) References Cited

U.S. PATENT DOCUMENTS

| | | | | |
|---|---|---|---|---|
| 2,631,521 | A | 3/1953 | Atkins | |
| 2,784,949 | A | 3/1957 | Dennon | |
| 2,876,113 | A | 3/1959 | Barton | |
| 3,404,811 | A | 10/1968 | Cernel | |
| 4,465,183 | A | 8/1984 | Saito et al. | |
| 4,757,916 | A | 7/1988 | Goncalves | |
| 4,982,875 | A | 1/1991 | Pozzi et al. | |
| 4,986,322 | A * | 1/1991 | Chibret et al. | 141/319 |
| 5,000,314 | A | 3/1991 | Fuller | |
| 5,186,323 | A | 2/1993 | Pfleger | |
| 5,209,565 | A | 5/1993 | Goncalves | |
| 5,277,303 | A | 1/1994 | Goyet et al. | |
| 5,297,696 | A | 3/1994 | Bernstein et al. | |
| 5,353,928 | A | 10/1994 | Schumacher | |
| 5,366,114 | A | 11/1994 | Bernstein et al. | |
| 5,465,835 | A | 11/1995 | Schumacher et al. | |
| 5,525,299 | A | 6/1996 | Lowe | |
| 5,735,320 | A | 4/1998 | Tune et al. | |
| 5,743,423 | A | 4/1998 | Franco | |
| 5,782,345 | A | 7/1998 | Guasch et al. | |
| 5,927,549 | A | 7/1999 | Wood | |
| 5,941,380 | A | 8/1999 | Rothman | |
| 5,984,141 | A | 11/1999 | Gibler | |
| 6,045,254 | A | 4/2000 | Inbar et al. | |
| 6,089,389 | A | 7/2000 | Sharon et al. | |
| 6,237,649 | B1 * | 5/2001 | Moisio et al. | 141/100 |
| 6,244,433 | B1 | 6/2001 | Vieu | |
| 6,390,342 | B1 | 5/2002 | Mabee | |

(Continued)

FOREIGN PATENT DOCUMENTS

| | | |
|---|---|---|
| EP | 0 692 235 A1 | 1/1996 |

*Primary Examiner*—Timothy L Maust
(74) *Attorney, Agent, or Firm*—Myers Andras Sherman LLP; Vic Lin

(57) ABSTRACT

The present invention is directed to a mixing unit comprising a sealed container joined to a second container. When the second container is fully united with the sealed container, a seal in the sealed container is breached and the contents of the first container and the second container can be mixed. The seal is breached by a bushing enclosed within the sealed container or enclosed in a coupler between the sealed container and the second container which is advanced against the seal, and ruptures the seal when the second container is advanced into the coupler of the coupler portion of the sealed container.

44 Claims, 7 Drawing Sheets

U.S. PATENT DOCUMENTS

| | | | | |
|---|---|---|---|---|
| 6,485,479 | B1 | 11/2002 | Knierbein | |
| 6,517,878 | B2 | 2/2003 | Heczko | |
| 6,527,109 | B2 | 3/2003 | Schoo et al. | |
| 6,527,110 | B2 | 3/2003 | Moscovitz | |
| 6,533,113 | B2 | 3/2003 | Moscovitz | |
| 6,540,070 | B1 | 4/2003 | Conwell | |
| 6,655,524 | B2 * | 12/2003 | De Laforcade | 206/222 |
| 6,668,875 | B2 | 12/2003 | Kojima et al. | |
| 6,709,424 | B1 | 3/2004 | Knierbein | |
| 6,814,229 | B2 | 11/2004 | Seckler | |
| 7,066,323 | B1 | 6/2006 | Reisman | |
| 2003/0017236 | A1 | 1/2003 | Makita et al. | |
| 2003/0153865 | A1 | 8/2003 | Connell et al. | |

* cited by examiner

COUPLING ASSEMBLY

CROSS REFERENCE TO RELATED APPLICATIONS

This application is related to co-pending U.S. patent application Ser. No. 11/112,931, filed on Apr. 21, 2005 and Ser. No. 11,451,996, filed on Jun. 12, 2006.

FIELD OF THE INVENTION

The present invention is directed to a method and apparatus for sealingly coupling two containers, each holding a different material, to enable the mixture of the different materials.

BACKGROUND OF THE INVENTION

Description of Prior Art and Related Information

Frequently, materials that are to be placed in use, must be compounded or mixed just prior to use because one or both materials are not stable, must be maintained in a sterile environment, is reactive with air and/or water, or the like. Such materials include pharmaceuticals, such as insulin, food products, such as chocolate flavored milk powder, chemical compositions, such as silver salt, hydride salts, and the like, hair dyes, epoxy cements, and the like. These are frequently referred to as two-component compositions. Frequently, one component must be maintained in the sealed state for stability, sterility, or the like. The other component frequently is stable and can be a solvent, such as water, or alcohol, propylene glycol, milk, and the like.

Traditionally, two-component compositions are furnished in two separate containers. One or both of the containers may be sealed to maintain its respective contents in a sealed environment. To mix the composition, each sealed container is broken open and its contents are mixed with the other component.

This has never been an ideal situation. One major drawback in this conventional approach consists of the probability of spills. If one of the materials is caustic, or flammable, or extremely reactive, a spill can lead to fire, or the like. If the two components must be mixed in stoichio metric amounts, the loss of a portion of one component can prevent successful mixing and preparation of the desired two-component composition. This is especially true for chemical compositions and a number of pharmaceutical compositions. The transfer of one component to another component also raises the problem of sterility. The air has literally millions of microbes per cubic centimeter. When one component is passed into the container for the other component, or a third container, microbes are carried along into the mixture, contaminating the composition. If either of the components are reactive or sensitive to oxygen, carbon dioxide, water vapor, or air, the mixing has an inherent disadvantage of exposing the component to such materials when blending the two components together.

There is a need for a sealed container which can be opened without exposure to the general environment to permit the mixing of two components together between the sealed container and the second container without exposing the component in the sealed container to the outside environment.

It is an object of the present invention to provide a sealed container having a coupler which threadingly receives a second container.

It is a further object of the present invention that when the sealed container is joined with the second container, the act of joining breaks the seal of the sealed container permitting communication between the first container and the second container.

It is still a further object of the present invention to provide a means of joining two containers together, one container being sealed, the joining causing the sealed container to be breached permitting communication between the joined first and second container so that the components of each container may be mixed.

It is an even further object of the present invention to provide a sealed container having a large seal which can be ruptured when the first container threadingly receives a second container to permit the easy flow of the component from the first container into the second container and the flow of the component of the second container into the first container to ensure thorough mixing.

SUMMARY OF THE INVENTION

The present invention provides structures and methods which overcome the deficiencies in the prior art.

The present invention is directed to a coupling assembly for connecting first and second containers comprising a hollow housing having a conduit with a wall, a first open end and a second open end, and a seal extending across the conduit separating the two open ends, the first end adapted to receive a first container, and the second end adapted to receive a second container; and a hollow bushing positioned in the conduit and adapted to be advanced toward the second end when the housing receives the first container in the first open end to breach the seal and open communication between the two open ends.

The second end of the coupling assembly is adapted to receive a second container and seal off the second container.

The conduit can be joined at its second open end with a second container and act as a closure for the second container sealing the second container.

The second container has a first opening in communication with the second open end of the conduit when the second container is joined to the coupling assembly. The second container can have a second opening. Preferably the second opening is closed off with a removal closure, such as a threaded cap.

The conduit, and the second open end have a common longitudinal axis. Preferably the seal is connected by its periphery to the conduit. The seal can be a membrane.

The seal can extend perpendicularly to the longitudinal axis of the conduit, or the seal can extend at an acute angle to the longitudinal axis of the conduit.

The hollow bushing has an open breaching end and an opposing open working end, the longitudinal axis of the bushing and the conduit have a common longitudinal axis. The open breaching end of the hollow bushing can be perpendicular to the longitudinal axis, or the open breaching end of the hollow bushing can be at an acute angle to the longitudinal axis. The open breaching end of the hollow bushing can have a cutting edge.

Preferably the seal is a membrane and is adapted to be torn around the greater portion of its periphery connected to the conduit when the seal is breached by the open breaching end of the bushing leaving at least a portion of its periphery connected to the wall of the conduit.

In another embodiment, the seal is adapted to be torn across its diameter and around the greater portion of two opposing peripheral sides connected to the conduit when the seal is breached into two segments leaving portions of its periphery connected to the wall of the conduit and to each segment.

In another embodiment, the seal is adapted to be torn into at least three pie-shaped segments extending from its center to its periphery and around a greater portion of the peripheral side of each pie-shaped segment connected to the wall of the conduit when the seal is breached leaving portions of its periphery connected to the wall of the conduit and to each segment.

Preferably the first open end of the conduit is threaded to receive the threaded nozzle of a first container. The open working end of the hollow bushing is adapted to form a sealing contact with the end of the threaded nozzle of the first container.

Preferably the second open end of the conduit is threaded to receive the threaded nozzle of a second container. The open breaching end of the bushing is adapted to form a seal with the interior wall of the conduit when the bushing is fully advanced into the conduit Another embodiment of the present invention is directed to a storage container with a coupling assembly for connecting to a first container comprising a hollow housing having a storage plenum with a first opening, a conduit with a wall, a first open end, a second open end communicating with the first opening, and a seal extending across the conduit separating the first opening from the first open end, the first open end adapted to receive a first container; and a hollow bushing positioned in the conduit and adapted to be advanced toward the second open end when the hollow housing receives the first container to breach the seal and open communication between the storage plenum and the first open end. The plenum storage can have a second opening. Preferably the second opening can be closed off with a closure.

The conduit, and the first open end have a common longitudinal axis.

The hollow bushing has an open breaching end and an opposing open working end with open communication between the two open ends. The open breaching end of the hollow bushing can be perpendicular to the longitudinal axis, or the open breaching end of the hollow bushing can be at an acute angle to the longitudinal axis. The open breaching end of the hollow bushing can have a cutting edge to aid in breaching the seal.

The seal can extend perpendicularly to the longitudinal axis of the conduit, or the seal can extend at an acute angle to the longitudinal axis of the conduit. Normally if the open breaching end is at an acute angle to the longitudinal axis, the seal will extend across to the conduit perpendicularly to the longitudinal axis, or vice versa.

The seal is preferably connected by its periphery to the conduit. The seal can be a membrane.

Preferably the bushing, the conduit, the open breaching end, and the open working end of the bushing having a common longitudinal axis.

Preferably the seal is adapted to be torn around the greater portion of its periphery connected to the conduit when the seal is breached leaving at least a portion of its periphery connected to the conduit. Preferably the portion of the periphery of the seal connected to the conduit after the seal is breached is thicker than the portion of the periphery of the seal torn when the seal is breached.

The seal is adapted to be torn across its diameter and around the greater portion of two opposing peripheral sides connected to the conduit when the seal is breached into two segments leaving two portions of its periphery connected to the wall of the conduit and to each segment The two portions of the periphery of the seal connected to the conduit after the seal is breached are thicker than the two opposing peripheral sides of the seal torn when the seal is breached.

The seal may also be adapted to be torn into at least three pie-shaped segments extending from its center to its periphery and around a greater portion of the peripheral side of each pie-shaped segment connected to the wall of the conduit when the seal is breached leaving portions of the seals' periphery connected to the conduit and to each segment.

The portion of the periphery of each pie-shaped segment of the seal connected to the conduit after the seal is breached is thicker than the greater portion of the peripheral side of each pie-shaped segment when the seal is breached.

Preferably the first open end of the conduit is threaded to receive the threaded nozzle of a first container.

The open working end of the hollow bushing is adapted to form a sealing contact with the end of the threaded nozzle of the first container, and the open breaching end of the bushing is adapted to form a seal with the interior wall of the conduit when the bushing is full advanced into the conduit to prevent leakage of the contents from the joined first and second containers with the coupling assembly.

DETAILED DESCRIPTION OF THE PREFERRED EMBODIMENTS

Figure 1:
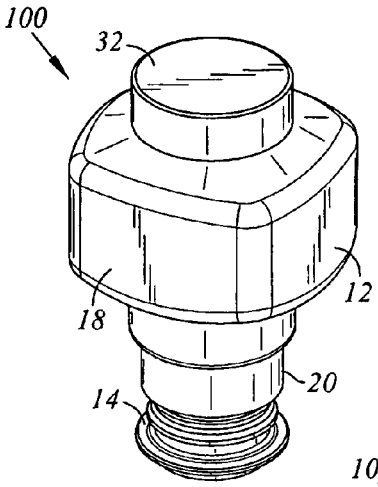
FIG. 1 is a top perspective view of the sealed container of the present invention including a portion of the neck of a second container threadingly engaging the sealed container.
Figure 2:
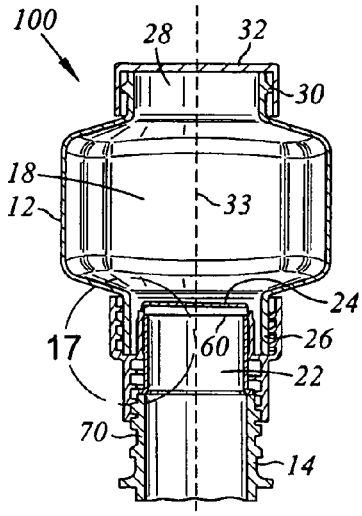
FIG. 2 is a side cross sectional view of FIG. 1.

A first preferred embodiment of a mixing unit is illustrated in FIGS. 1-17 and designated generally by the reference numeral 100. In FIGS. 1-5, the preferred embodiment 100 comprises a sealed container 12 joined with a second container 14 by a coupling assembly 20. The sealed container 12 comprises a first container, or hollow housing, 18, a coupler 20, and an axially movable bushing 22 within the coupler. The first container 18 preferably has a threaded first opening 24 with a threaded neck 26 adapted to threadingly mate with the coupler 20, and an external opening 28 with preferably a threaded neck 30 adapted to be sealed off with threaded cap 32. In FIG. 2, the sealed container 12 defines an axis 33.

Though the first opening 24 and the external opening 28 are illustrated with threaded connections in the preferred embodiment, it is to be expressly understood that a variety of fastening and/or joining mechanisms may be employed to couple these openings 24, 28 to other structures.

Figure 8:
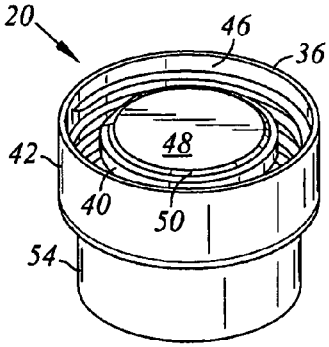
FIG. 8 is a perspective view of the coupler of FIG. 6.
Figure 9:
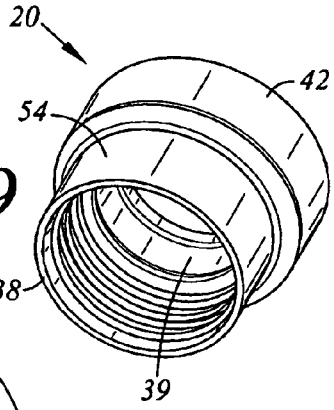
FIG. 9 is a bottom perspective view of the coupler of FIG. 6.
Figure 10:
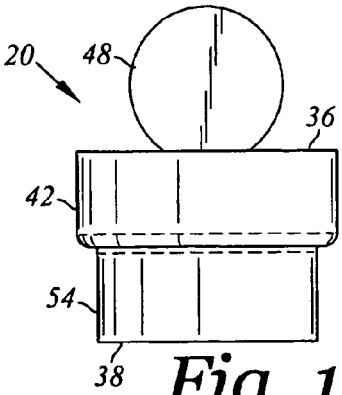
FIG. 10 is a side perspective view of the coupler of FIG. 6 with the seal breached.
Figure 11:
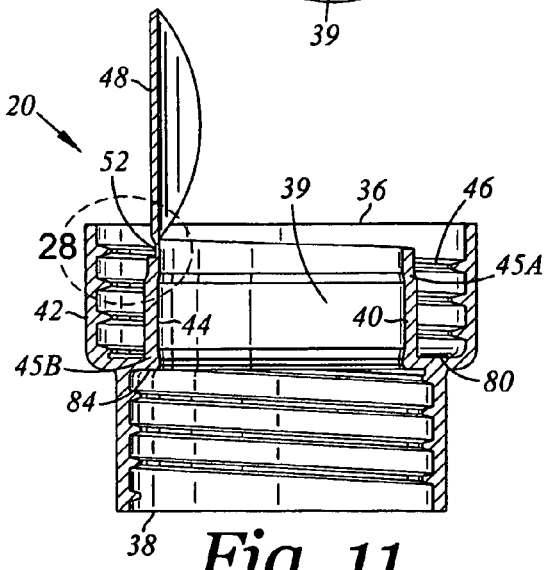
FIG. 11 is a cross sectional view similar to FIG. 7 with the seal breached.
Figure 12:
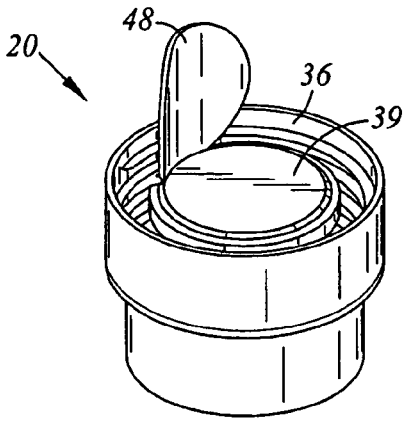
FIG. 12 is a top perspective view similar to FIG. 8 with the seal breached.
Figure 13:
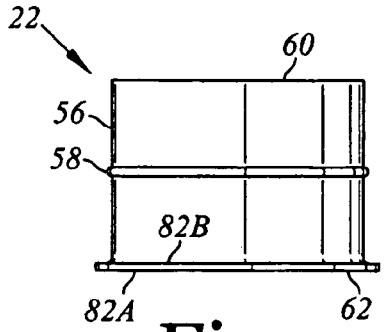
FIG. 13 is a side plan view of the bushing of the coupler shown in FIGS. 2 through 5.
Figure 14:
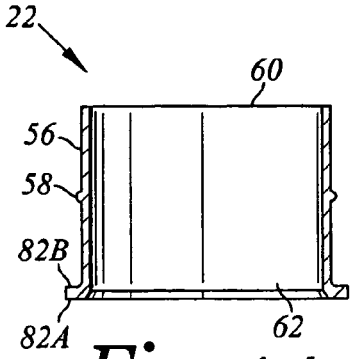
FIG. 14 is a cross sectional view of FIG. 13.
Figure 15:
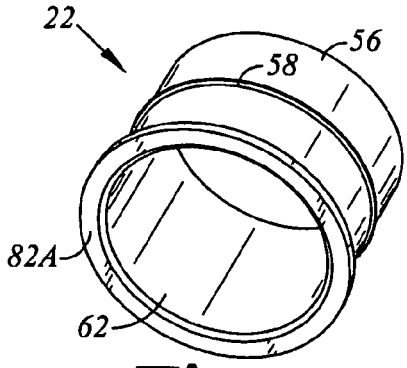
FIG. 15 is a bottom perspective view of FIG. 13.
Figure 16:
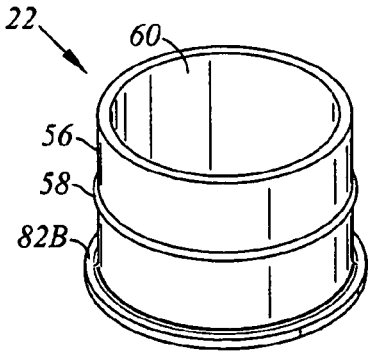
FIG. 16 is a top perspective view of FIG. 13.

In FIGS. 6-11, the coupler 20 has a first end portion 36 and a second end portion 38 with axial passage 39 communicating with the two ends. The first end portion 36 has an first inner annular wall 40 and a second outer annular wall 42 with an annular channel 46 therebetween open to the first end portion 36. The annular channel 46 receives the threaded neck 26 of the first container 18. The inner side of the second annular wall 42 is threaded to engage the threads on the threaded neck 26. The axial passage 39 between the first end portion 36 and second end portion 38 is sealed off with a generally planar seal 48 secured to the first annular wall 40. The seal 48 is connected to the first annular wall 40 with a peripheral seal wall 50, as shown in FIG. 8, and a hinge 52 as shown in FIG. 11. The coupler 20 has a single annular wall 54 at the second end portion 38. The interior side of the annular wall 54 is threaded to threadingly engage the threaded neck of the second container 14.

Figure 28:
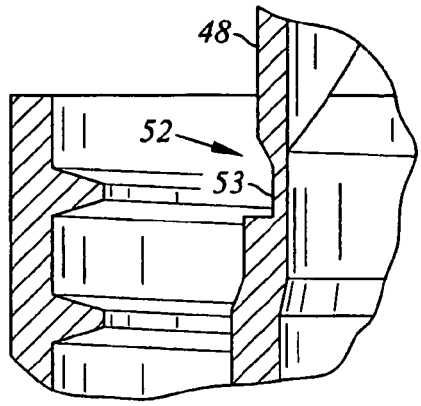
FIG. 28 is a close-up view of the breakable seal in FIG. 11, illustrating the recessed hinge.

When the seal 48 is breached, ruptured, torn, or the like, from its sealed connection to the interior of the coupling assembly via the peripheral seal wall 50, the seal remains tethered to the coupler 20 via hinge 52. Hinge 52 is designed with an undercut so that it rotates outwardly (shown upwardly in FIGS. 8 and 11) from the interior of the first annular wall 40 so that the bushing 22 is not hung up by the hinge 52 once the seal is ruptured (see FIGS. 11 and 17). As shown in FIGS. 11 and 28, both the undercut and the lesser thickness of the hinge 52, as compared to the rest of the seal 48, facilitate the rotation of the seal 48 when broken while keeping the seal 48 coupled to the first annular wall 40 so that the seal 48 will not get dislodged into the mixture.

In FIGS. 13-16, the bushing, or tube, 22 comprises a cylindrical body 56 having a first end 60 and a second end 62. A combination sealing ring and retaining ring 58 encircles the outer wall of the body 56 circumferentially. The second end 62 of the bushing 22 is flared out to form a relatively large working area, the purpose of which will be explained below. In use, it is envisioned that the sealed container 12 and the second container 14 will be supplied separately, or they can be in the same package and if desired, they can be pre-joined together. The bushing 22 is fitted within the portion of the axial passage 39 of the coupler 20 defined by the first annular wall 40 (see FIGS. 2, 3, and 17).

Figure 17:
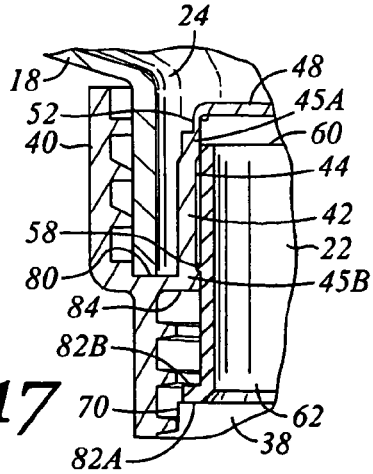
FIG. 17 is an enlargement along encircling line 17 of FIG. 2.

Initially, the first end 60 of the bushing 22 is spaced away or back from the seal 48 as shown in FIGS. 2 and 17. When the sealed container 12 and the second container 14 are joined and the second container 14 is fully threaded into the second end 38 of the coupler, the end of the threaded neck 70 of the second container 14 engages the flared out second end 62 of the bushing 22. As the threaded neck 70 of the second container 14 is threadedly advanced into the second end of the coupler 20, the end of the threaded neck 70 engages the second end 62 of the bushing 22 and pushes the bushing 22 toward the seal 48 so that the first end 60 of the bushing 22 engages and ruptures or breaches seal 48. In the preferred embodiment, the seal 48 is not strictly perpendicular to the longitudinal axial passage, but rather set a slight angle toward the first container 12 to facilitate easy rotation when abutted by the axially moving bushing 22.

Preferably, the longitudinal axes of the threaded necks of the seal container and second container, the axial passage of the coupler, and the longitudinal axis at the bushing are coaxial. As the bushing 22 is advanced toward the seal 48, it contacts the portion of the seal 48 closest to the second end 38. The first end 60 of the bushing 22 engages the seal 48 and forces the portion of the seal 48 in contact with the bushing 22 toward the first end portion 36 of the coupler 20 tearing the peripheral seal wall 50 at the point of contact. As the bushing 22 is further advanced toward the first end portion 36 of the coupler 20, the peripheral seal wall 50 is progressively ruptured around the periphery of the seal 48 until all that remains securing the broken seal 48 to the coupler 20 is hinge 52. In the preferred embodiment, the bushing 22 comprises a flat or round distal edge that pushes the seal 48 to cause the rupture. Alternatively, the bushing 22 may be formed with a distal cutting edge to assist in cutting the seal 48 to cause the rupture.

Thus, the bushing 22 keeps the hinged, ruptured seal 48 roughly parallel to the longitudinal axis of the axial passage 39 to furnish a relatively large passageway with minimal hindrance between the previously sealed container 12, now unsealed, with the second container 14. The bushing 22 now serves as a bridging conduit between the two containers 12, 14 to permit the mixing of materials between the first container 12 and the second container 14. The breached seal 48 is shown in FIGS. 4, 5, 10, 11, and 12. It is advantageous to maintain the seal 48 with the coupler 20 after the breach so that when the ingredients or materials between the first container 12 and the second container 14 are mixed, the seal 48 is not mixed therewith but remains connected with the coupler 20 and positioned to not block the axial passage.

In the first preferred embodiment of the present invention, when the sealed container 12 is supplied apart from the second container 14, the second end portion 38 of the coupler 20 is capped off with a plug, friction fit or threaded, or with a temporary seal such as a paper seal, foil seal, plastic seal, or the like, to prevent contamination of the axial passageway 39.

To retain the bushing 22 within the coupler 20 and to provide an additional labyrinth seal for the bushing 22, the bushing 22 includes the annular ring seal 58 about the circumference of the outer wall of the body 56. This ring seal 58 rides in the inner wall 44 of the first annular wall 40. In FIG. 11, the inner annular wall 44 has a shoulder 45A at its upper extremity and a shoulder 45B at it lower extremity. In the manufacture of the coupler 20, the bushing 22 is pushed into the axial passage 39. In FIG. 17, the ring seal 58 is pushed pass shoulder 45B so that the ring seal 58 is positioned against the inner annular wall 44 and retained in the inner annual wall area by the shoulders 45A and 45B. The annular ring seal 58 retains the bushing 22 in the coupler 20 and helps minimize leakage around the bushing 22 when the planar seal 48 is broken and the materials of the first container and second container are being mixed.

When the mixing unit 100 is joined together, the sealed container 12 and the second container 14 are fluid communication with each other while the coupler 20 seals the connection between the containers 12, 14 to prevent leakage. The threaded neck 26 of the first container 12 at the juncture between the first annular wall 40 and the second annular wall 42 of the coupler 20 has a transverse sealing surface 80 at the bottom of the annular channel 46. Similarly, in FIG. 17, the coupler 20 includes a second transverse sealing surface 84 configured to abut and form a seal with sealing surface 82B of the bushing 22 as described below.

Figure 5:
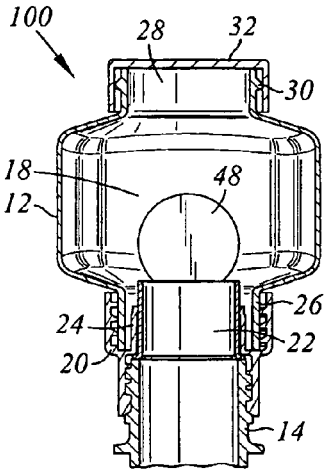
FIG. 5 is another cross sectional view at a right angle to FIG. 4 of the sealed container of FIG. 1.
Figure 3:
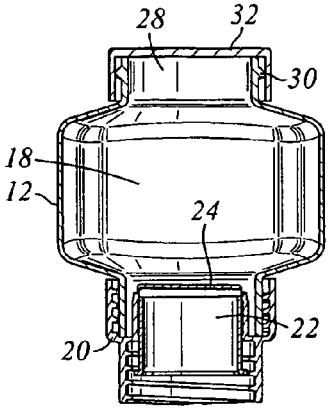
FIG. 3 is a side cross sectional view of the sealed container of FIG. 1.
Figure 4:
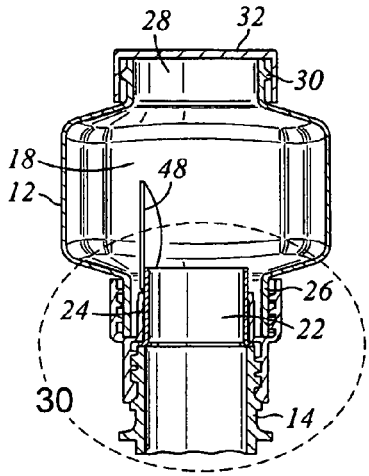
FIG. 4 is a side cross sectional view of the sealed container of FIG. 1 wherein the seal has been breached.
Figure 6:
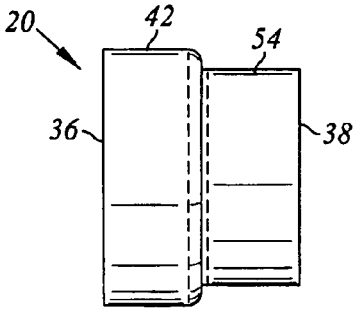
FIG. 6 is a plan side view of the coupler of the sealed container of FIG. 1.
Figure 7:
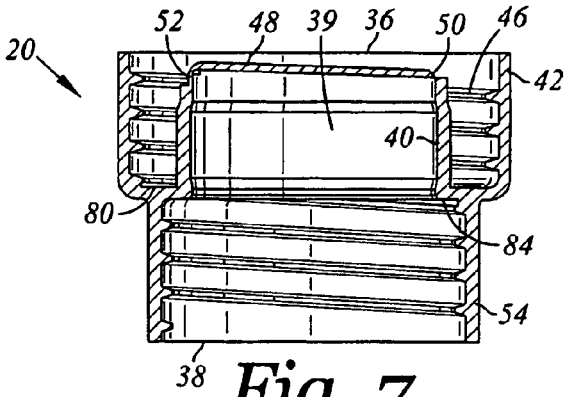
FIG. 7 is an enlarged cross sectional view of FIG. 6.

The mixing unit 100 must have a sealed relationship between the sealed container 12, the coupler 20, and the second container 14 to prevent leakage. In other words, while there is fluid communication between the interiors of the container 12, coupler 20 and the second container 14 once the seal 48 is breached and the connection of the mixing unit 100 is established, this fluid communication must be sealed from an exterior of the mixing unit 100 in order to prevent leakage. The end of the threaded neck 26 of the sealed container 12 when fully engaged with the coupler 20 is seated against the first transverse sealing surface 80 to form a seal between the coupler 20 and the sealed container 12. In FIGS. 4, 5 and 17, when the second container 14 is fully threaded into the second end 38 of the coupler 20 which advances the bushing 22 fully into the coupler 20 (see FIGS. 4,5), the sealing surface 82B of the bushing 22 engages the sealing surface 84 of the coupler 20 forming a seal therebetween. The end of the neck 70 of the second container 14 engages the sealing surface 82A of the bushing 22 forming another seal. This is the preferred sealing arrangement for the mixing unit 10, but obviously other sealing arrangements can be arranged.

In summary, three waterproof seals are formed in the preferred embodiment of the unit 100 when the temporary seal 48 is breached and the unit 100 is completely assembled: a first seal between the first container 12 and the coupler 20, a second seal between the bushing 22 and the coupler 20, and a third seal between the second container 14 and the bushing. The combination of these three seals forms a watertight package that enables the user to mix the contents without any spillage.

A preferred method of mixing contents in two separate containers is also provided according to the invention. In particular, the first container 12 may contain a first material that is originally sealed by the breakable seal 48. As an example and not by way of limitation, the first material may comprise dry contents, such as protein powders, milk powders, vitamin powders, herbal supplements, and the like. The first material may also comprise liquid or "wet" contents. Similarly, the second container 14 may contain a second material that is either dry or wet. In one preferred method of mixing, the second container 14 may comprise a standard 500 mL water bottle where the second material comprises drinking water. It will be appreciated, therefore, that by screwing the second container 14 of water to the coupler 20, a watertight mixing unit 100 is formed with a single motion. Now, the user is free to shake the unit 100 and mix the respective contents without any spillage.

Figure 18:
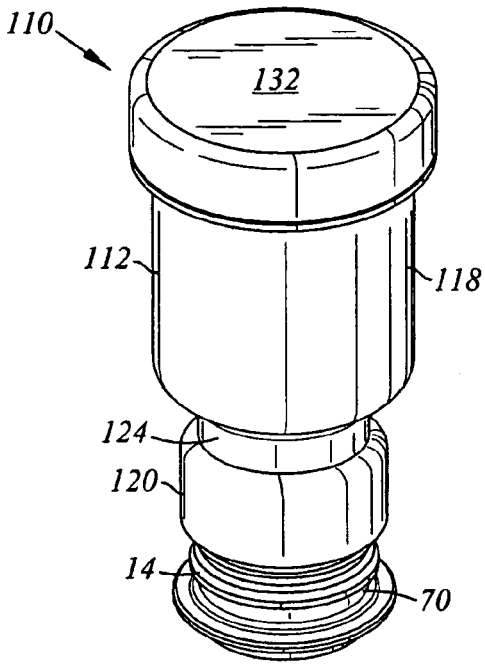
FIG. 18 is a top perspective view showing another embodiment of sealed container of the present invention joined with a second container.
Figure 19:
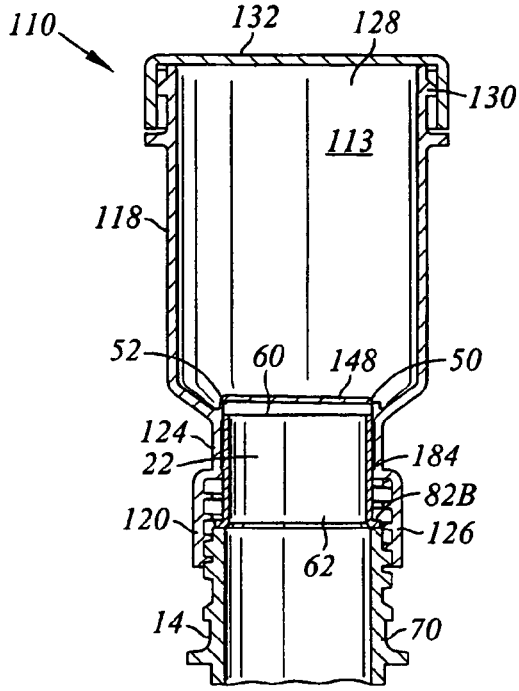
FIG. 19 is a side cross sectional view of FIG. 18.
Figure 20:
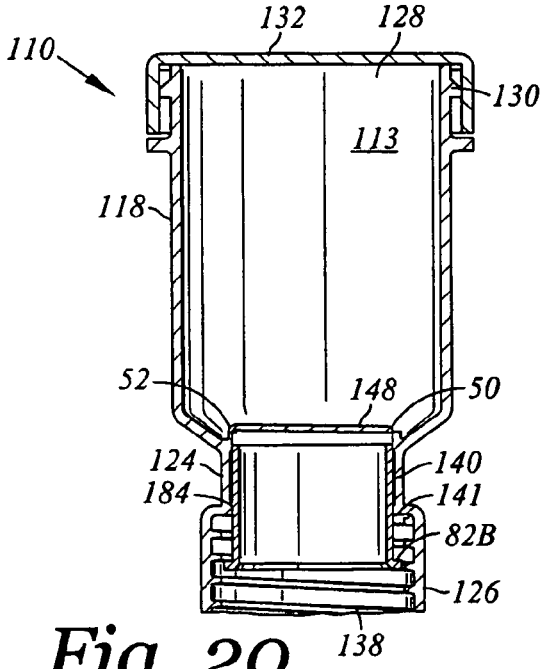
FIG. 20 is a side cross sectional view of the sealed container similar to FIG. 19.

A second preferred embodiment of the mixing unit is illustrated in FIGS. 18-20 and designed generally by the reference numeral 110. The mixing unit 110 comprises a sealed container 112 and a second container 14. The sealed container 112 has a container portion 118, a coupling portion 120, and a neck portion 124 joining the coupling portion 120 and the container portion 118. A bushing 22 is positioned within the sealed container 112. The coupling portion 120 has a threaded receiver 126 which has an open end 138. The open end is adapted to receive the threaded neck 70 of the second container 14. Within a hollow chamber 113 of the container portion 118 at the juncture with the coupling portion 120, a seal 148 substantially similar to the seal of the first preferred embodiment described above is disposed. The seal 148 is secured in a sealed relationship with the bottom of the sealed container 112 by a peripheral seal wall 50 and a hinge 52. To form a mixing unit 110, the second container 14 is inserted by its threaded neck 70 into the open end 138 of the receiver 126. The threaded neck 70 is threaded into the threaded receiver 126 and engages the flared out second end 62 of the bushing 22 and advances the bushing 22 toward the seal 148. During its advance, the bushing 22 at its first end 60, engages the seal 148 and ruptures the seal 148 as described above. The hinge 52 retains the ruptured seal 148 within the cavity 113.

The sealing of the second container 14 with the sealed container 112 is equally important in this embodiment. There must be an adequate seal between the second container 14 and the coupling portion 120. On the inside of the coupler portion 120 at the juncture with the neck portion 124, there is a sealing surface 184 similar to sealing surface 84 in the first embodiment described above. The sealing surface 82B of the bushing 22 engages sealing surface 184 to form a seal when the bushing 22 is fully advanced into the originally sealed container 112. The end of the threaded neck 70 of the second container 14 engages the sealing surface 82B of the bushing 22. When the bushing 22 is fully engaged and advanced within the originally sealed container 12, a seal is formed between the sealing surface 82A and the end of the threaded nozzle 70 of the second container.

Although the invention is described with its specific embodiments, the invention also includes obvious variance of the embodiments described.

Figure 21:
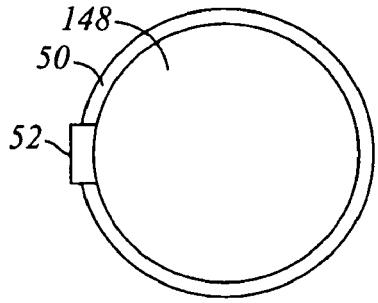
FIG. 21 is a top plan view of a seal of the present invention.
Figure 22:
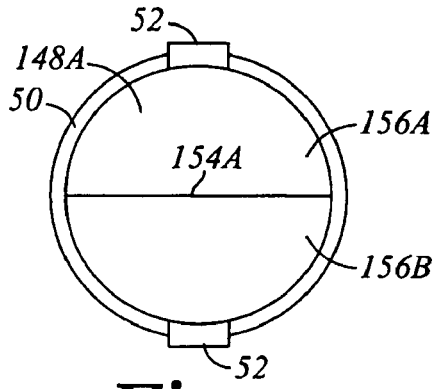
FIG. 22 is an alternative embodiment of the seal of the present invention.
Figure 23:
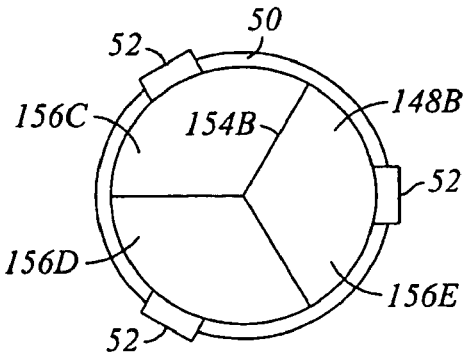
FIG. 23 is still another embodiment of the seal of the present invention.
Figure 24:
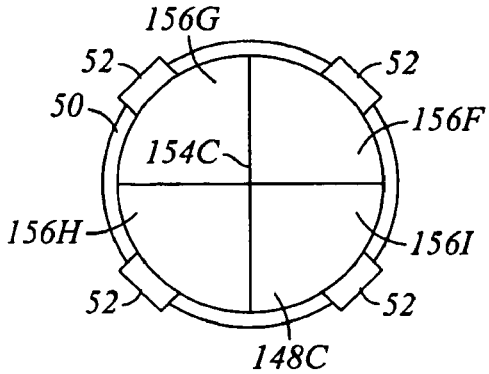
FIG. 24 is a top plan view of still another embodiment of the seal of the present invention.

Referring to FIGS. 21-24, several embodiments of the breakable seal are shown. In FIG. 21, the breakable seal 148 can be a plate, a sheet, a membrane, or the like. The seal 148 is secured to the coupler or the sealed container as the case may be by a peripheral seal wall 50. In FIG. 22, the seal 148A can be grooved with grooves 154A or 154B or 154C. The grooves aid in the rupture or breaching of the seal to permit the seal to be torn into hinged segments. For example, the seal 148A of FIG. 22 would be broken into two segments, or flaps, 156A and 156B, similar to that of a duck bill valve. Similarly, the seal 148B of FIG. 23 would be broken up into three segments, or flaps, 156C, 156D, and 156E. In a similar fashion, the seal 148C of FIG. 24 would be broken up into four pie-shaped segments, or flaps, 156F-156I. Grooves 154 are thinned out portions of the seal to permit the seal to be torn, ruptured, or breached along the groove lines. Each segment, regardless if it is a single segment like the seal 148 shown in FIG. 21 or the four segments shown in FIG. 24, are tied to the passage wall of the coupler or to the sealed container by hinges 52. Although four seals are shown which can be divided up into one, two, three, or four segments, the seal can be divided up into more segments, such as five segments, six segments, seven segments, or eight segments, and the like.

Although the sealed containers 12 is shown with an external opening 28, it is to be expressly understood that the sealed containers can be manufactured without such openings.

To aid in the rupture of the seal, a portion of the seal should first be ruptured, torn, or breached and then the peripheral seal wall is progressively torn circumferentially around the seal.

Figure 25:
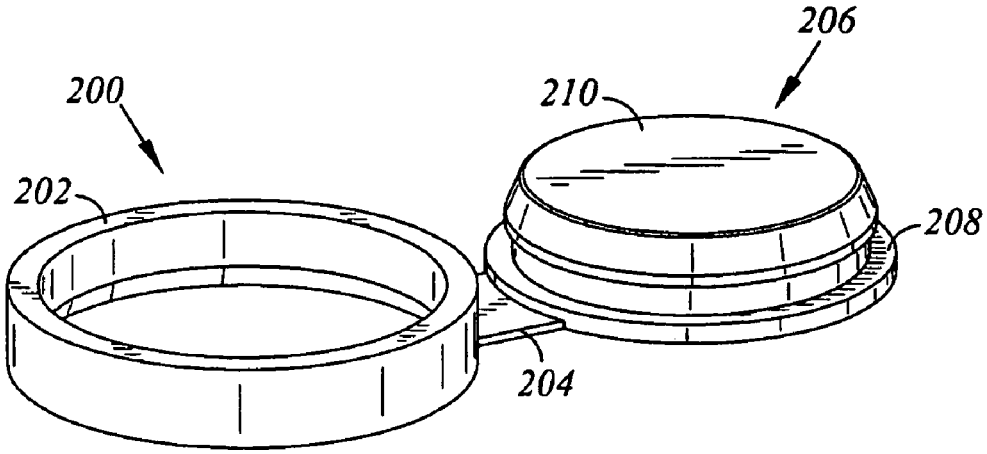
FIG. 25 is a perspective view of a preferred embodiment of a breakable clip seal.
Figure 26:
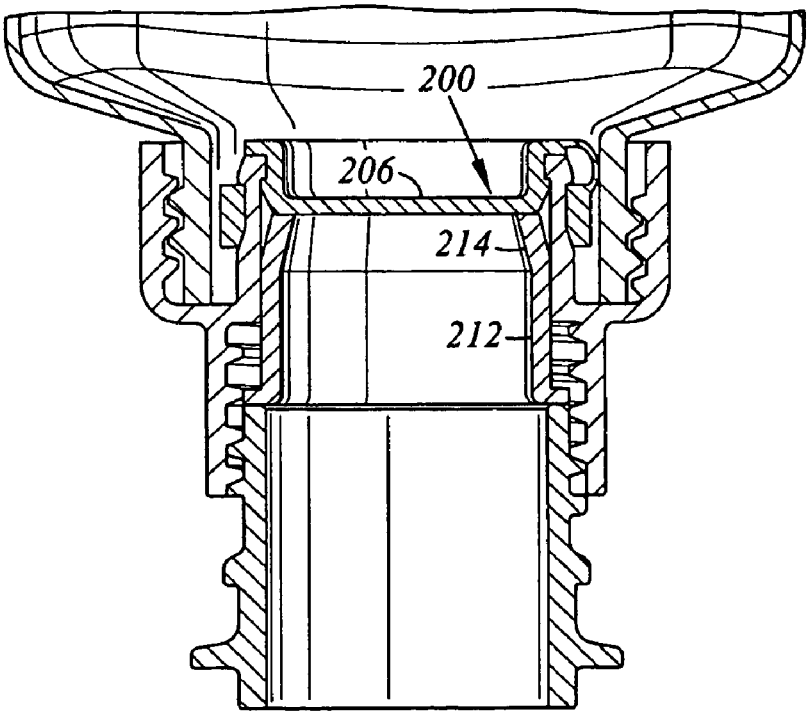
FIG. 26 is a cross-sectional view of a system utilizing the breakable clip seal of FIG. 25.

An alternate embodiment of a breakable clip seal 200 is illustrated in FIGS. 25 and 26. The clip seal 200 includes a ring or band 202 configured to secured to the outer surface of the inner annular wall 40 of the coupler 20. The clip seal 200 includes a connector or tether 204 that couples a sealing cap 206 to the band 202. The sealing cap 206 comprises an outer rim 208 and a protuberance 210 configured to form a seal with the inner annular wall 40 as shown in FIG. 26.

FIG. 26 also illustrates an alternative embodiment of a bushing 212 having a tapered end 214. When the tapered bushing 212 is advanced toward the clip seal 200, the bushing 212 will abut and push open the clip seal 200 by causing the cap 206 to rotate away (which in FIG. 26 would be clockwise) from the inner annular wall 40.

Figure 27:
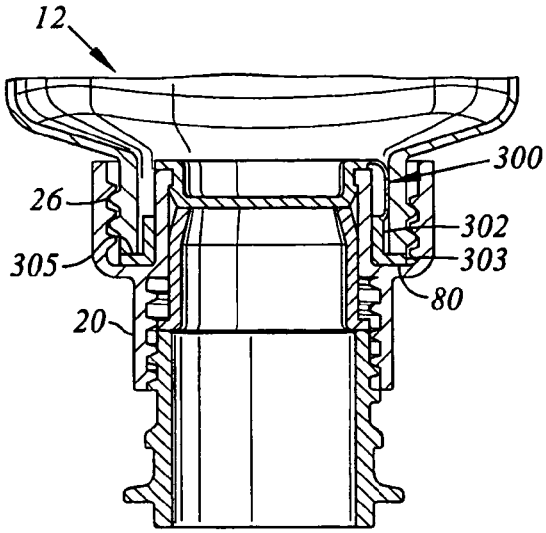
FIG. 27 is a cross-sectional view of a system utilizing an alternate embodiment of a breakable clip seal.

An alternative embodiment of a clip seal 300 is illustrated in FIG. 27. The breaching of the clip seal 300 is performed similarly to the clip seal 200 in FIGS. 25-26. The primary difference in the clip seal 300 in FIG. 27 is that the clip seal 300 comprises a band 302 having an annular horizontal rim 303. As shown in FIG. 27, the horizontal rim 303 is configured to be sandwiched in between the transverse sealing surface 80 of the coupler 20 and a distal end 305 of the threaded neck 26 of the first container 12.

FIG. 28 is a close-up view of the recessed hinge 52 of the breakable seal 48. In particular, the hinge 52 includes a recess, or undercut, 53 that facilitates rotation of the seal 48 when the seal 48 is breached.

Figure 29:
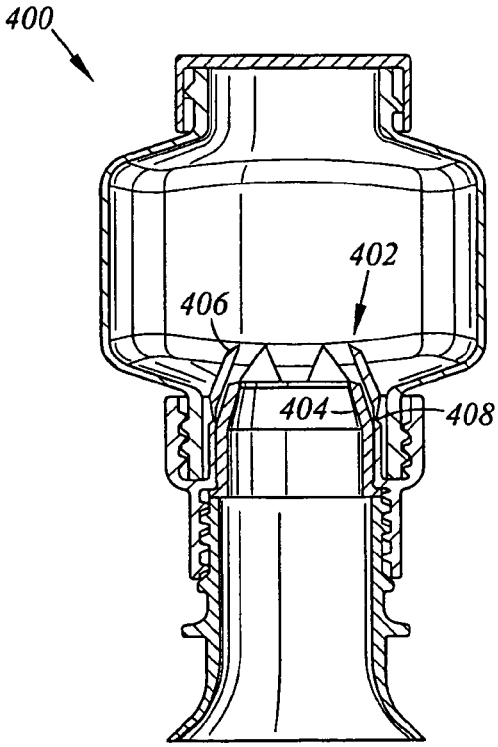
FIG. 29 is a cross-sectional view of a system utilizing a multi-flap breakable seal, illustrating the recessed hinge of each segment.

FIG. 29 is a cross-sectional view of a system 400 incorporating a multi-flap breakable seal 402 and a tapered bushing 404. The breakable seal 402 comprises multiple segments, or flaps, 406, each having a recessed hinge 408 formed with an undercut so as to facilitate rotation of each segment 406 when the seal 402 is breached.

Figure 30:
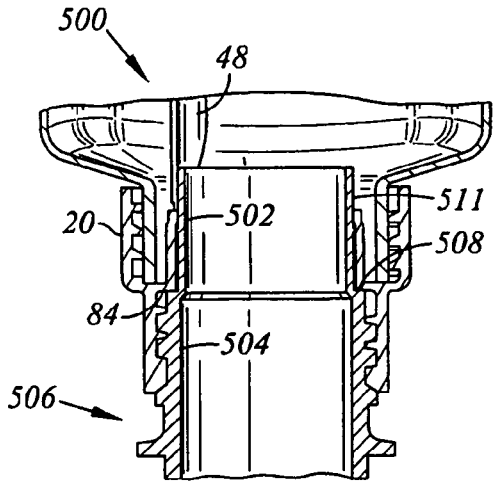
FIG. 30 is a cross-sectional view of an alternate embodiment of the system wherein a distal neck of the second container comprises an integral bushing.

In the first preferred embodiment 100 of the mixing unit described above and illustrated in FIGS. 1-17, the bushing 22 is separate from the second container 14. FIG. 30 is cross-sectional view of an alternative embodiment 500 of the mixing unit wherein the bushing 502 is formed integrally with a threaded neck 504 of the second container 506. The outer diameter of the integral bushing 502 is less than the outer diameter of the threaded neck 504 so as to form a shoulder, or stop, 508 to form a seal with the bottom transverse sealing surface 84 of the coupler 20. Also, the outer surface 511 of the integral bushing 502 is substantially smooth to enable the bushing 502 to be smoothly advanced through to breach the seal 48 when the second container 506 is screwed onto the coupler 20.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

The invention claimed is:

1. A coupling assembly for connecting first and second containers comprising:

a hollow housing having a conduit with a wall, a first open end and a second open end, and a seal extending across the conduit separating the two open ends, the first end adapted to threadably receive a first container; and a hollow bushing positioned in the conduit and adapted to be advanced toward the second end in a direction away from the first container when the first container is screwed toward the hollow housing, the hollow bushing being configured to breach the seal and open communication between the two open ends, and wherein no portion of the breached seal is dislodged.

2. The coupling assembly according to claim 1 wherein the second open end is adapted to receive a second container and form a seal with the second container.

3. The coupling assembly according to claim 1 wherein the conduit is joined at its second open end with a second container.

4. The coupling assembly according to claim 3 wherein:

the first container is configured to contain fluid; and the second container has a first opening in communication with the conduit and is configured to contain mix ingredients.

5. The coupling assembly according to claim 3 wherein the second container has a second opening and the second opening is closed off with a closure.

6. The coupling assembly according to claim 1 wherein:

the hollow bushing comprises an open breaching end; and the breached seal is connected to the conduit by at least a portion of its periphery.

7. The coupling assembly according to claim 6 wherein the seal extends at an acute angle to the longitudinal axis of the conduit.

8. The coupling assembly according to claim 6 wherein the open breaching end of the hollow bushing has a cutting edge.

9. The coupling assembly according to claim 6 wherein the seal is adapted to be torn around the greater portion of its periphery connected to the conduit when the seal is breached leaving at least a portion of its periphery connected to the wall of the conduit.

10. The coupling assembly according to claim 6 wherein the seal is adapted to be torn across its diameter and around two opposing peripheral sides connected to the conduit when the seal is breached leaving at least a portion of its periphery connected to the wall of the conduit.

11. The coupling assembly according to claim 6 wherein the seal is adapted to be torn into at least three pie-shaped segments extending from its center to its periphery and around a greater portion of the peripheral side of each pie-shaped segment connected to the wall of the conduit when the seal is breached leaving at least a portion of each peripheral side connected to the wall of the conduit.

12. The coupling assembly according to claim 1 wherein the first container comprises a standard water bottle with a threaded nozzle, and the first open end of the conduit is threaded to receive the threaded nozzle of the standard water bottle.

13. The coupling assembly according to claim 12 wherein an open lower end of the hollow bushing is adapted to form a sealing contact with the end of the threaded nozzle of the standard water bottle.

14. The coupling assembly according to claim 1 wherein the second open end of the conduit is threaded to receive the threaded nozzle of a second container.

15. The coupling assembly according to claim 1 wherein the open breaching end of the bushing is adapted to form a seal with the interior wall of the conduit when the bushing is full advanced into the conduit.

16. The coupling assembly of claim 1 wherein the hollow bushing comprises a tapered end.

17. The coupling assembly of claim 1 wherein the hollow bushing comprises a breaching end, an opposite lower end and a flange adjacent to the lower end configured to form a seal with the hollow housing when the hollow bushing is advanced toward the second end of the hollow housing.

18. The coupling assembly of claim 6 wherein:

the hollow bushing comprises a breaching end; and the breaching end is configured to move beyond the portion of the periphery of the seal attached to the conduit.

19. A storage container with a coupling assembly for connecting to a first container comprising:

a hollow housing having a hollow chamber with a first opening, a conduit in communication with the first opening, the conduit having an annular wall, and a first open end, and a seal extending across the conduit separating the first opening from the first open end, the first open end adapted to threadably receive a first container; and a hollow bushing positioned in the conduit between the seal and the first container, and adapted to be advanced toward the first opening in a direction away from the first container when the first container is screwed toward the hollow housing to breach the seal and open communication between the storage plenum and the first open end, wherein no portion of the breached seal is dislodged.

20. The storage container with a coupling assembly according to claim 19 wherein the storage plenum has a second opening that is closed off with a cap.

21. The storage container with a coupling assembly according to claim 19 wherein the open breaching end of the hollow bushing is at an acute angle to the longitudinal axis.

22. The coupling assembly according to claim 19 wherein the seal extends at an acute angle to the longitudinal axis.

23. The storage container with a coupling assembly according to claim 19 wherein the open breaching end of the hollow bushing has cutting edge.

24. The storage container with a coupling assembly according to claim 19 wherein the breached seal is connected to the conduit by at least a portion of its periphery.

25. The storage container with a coupling assembly according to claim 19 wherein the seal is adapted to be torn around the greater portion of its periphery connected to the conduit when the seal is breached leaving at least a portion of its periphery connected to the conduit.

26. The storage container with a coupling assembly according to claim 19 where the portion of the periphery of the seal connected to the conduit after the seal is breached is thicker than the portion of the periphery of the breached seal disconnected from the conduit.

27. The storage container with a coupling assembly according to claim 19 wherein the seal is adapted to be torn across its diameter and around two opposing peripheral sides connected to the conduit when the seal is breached leaving at least two portions of its periphery connected to the wall of the conduit.

28. The storage container with a coupling assembly according to claim 19 where the two portions of the periphery of the seal connected to the conduit after the seal is breached are thicker than the two opposing peripheral sides.

29. The storage container with a coupling assembly according to claim 19 wherein the seal is adapted to be torn into at least three pie-shaped segments extending from its center to its periphery and around a greater portion of the peripheral side of each pie-shaped segment connected to the wall of the conduit when the seal is breached leaving at least a portion of each peripheral side connected to the wall of the conduit.

30. The storage container with a coupling assembly according to claim 29 where the portion of the peripheral side of each pie-shaped segment connected to the conduit after the seal is breached is thicker than the greater portion of the peripheral side of each pie-shaped segment.

31. The storage container with a coupling assembly according to claim 19 wherein the first open end of the conduit is threaded to receive the threaded nozzle of a first container.

32. The storage container with a coupling assembly according to claim 19 wherein the open working end of the hollow bushing is adapted to form a sealing contact with the end of the threaded nozzle of the first container.

33. The storage container according to claim 19 wherein bushing comprises an open breaching end, an opposite lower end and a flange adjacent to the lower end, the flange being adapted to form a seal with the interior wall of the conduit when the bushing is fully advanced into the conduit.

34. The storage container according to claim 19 wherein the seal comprises a clip seal.

35. The storage container according to claim 19 wherein the seal comprises a recessed hinge.

36. The storage container according to claim 19 wherein the bushing is tapered.

37. The storage container according to claim 19 further comprising a second container having a threaded neck, wherein the bushing is integral with the threaded neck.

38. The storage container of claim 19 wherein:

the hollow bushing comprises a breaching end, and the breaching end is configured to move beyond the portion of the periphery of the seal attached to the conduit.

39. The storage container of claim 19, wherein:

the first container comprises a water bottle with a threaded nozzle; and the first open end of the hollow housing is configured to threadably mate with the threaded nozzle of the water bottle.

40. A coupling assembly comprising:

a container configured to hold mix ingredients;

a bottle configured to hold fluids;

a coupler coupled to the container and threadably coupled to the bottle, the coupler comprising a seal configured temporarily to prevent the mix contents from escaping into the bottle;

a bushing movable with respect to the coupler and configured to breach the seal when the bottle is screwed into the coupler, the bushing being configured to be pushed by the bottle toward the seal, wherein no portion of the breached seal is dislodged.

41. The assembly of claim 40 wherein the breached seal is connected to the coupler by at least a portion of a periphery of the seal.

42. The assembly of claim 41, wherein the bushing comprises a breaching end and an opposite lower end, and the breaching end is configured to advance past the periphery of the breached seal connected to the coupler when pushed by the bottle.

43. The assembly of claim 40, wherein the container and the coupler are integral.

44. The assembly of claim 40 wherein the container and the coupler are separate.

* * * * *